United States Patent [19]

Serzen

[11] Patent Number: 5,002,416

[45] Date of Patent: Mar. 26, 1991

[54] COVER SPACER FOR BINDERS

[76] Inventor: Russell D. Serzen, 401 Bayberry Dr., Ft. Lauderdale, Fla. 33317

[21] Appl. No.: 519,925

[22] Filed: May 7, 1990

[51] Int. Cl.[5] ..... B42F 13/00

[52] U.S. Cl. ..... 402/74; 402/73; 402/80 R; 402/80 P

[58] Field of Search ..... 402/73, 74, 76, 78, 402/80 R, 502, 80 P; 281/33

[56] References Cited

U.S. PATENT DOCUMENTS

| | | | |
|---|---|---|---|
| 501,751 | 7/1893 | Waring | 402/74 |
| 1,414,758 | 5/1922 | Stavenhager | 402/80 R |
| 3,315,642 | 2/1982 | Erichiello | 402/73 |
| 3,612,709 | 10/1971 | Miyamoto | 402/22 |
| 3,936,202 | 2/1976 | Bragituli | 281/33 |
| 4,056,326 | 11/1977 | Crawford | 402/30 |
| 4,531,764 | 7/1985 | Chang | 402/80 P |
| 4,744,689 | 5/1988 | Sternberg | 402/73 |
| 4,761,091 | 8/1988 | Ominato et al. | 402/76 |

*Primary Examiner*—Paul A. Bell
*Assistant Examiner*—Hwei-Siu Payer
*Attorney, Agent, or Firm*—Willian Brinks Olds Hofer Gilson & Lione

[57] ABSTRACT

A spacing element for a paper binding device for maintaining the covers of the device in a substantially parallel relation to provide for easy storage thereof. The spacing element comprises a base portion adapted to be affixed to the inside surface of one of the binder covers and a spacing portion extending substantially transversely from the base portion and adapted to engage the inside surface of the opposite cover when the covers are closed. The spacing portion preferably includes a plurality of notches for adjusting its length to accommodate binding devices of different size. The spacing element is further preferably provided with adhesive arranged on the underside of the base portion for affixing the spacing element to an inside surface of the binder cover.

14 Claims, 2 Drawing Sheets

COVER SPACER FOR BINDERS

TECHNICAL FIELD

This invention relates to spacers for binder covers, and more particularly to a spacer that is affixable to binder covers to maintain the covers in a substantially parallel relation and that is adjustable in length to accommodate binders of different size.

BACKGROUND ART

Loose leaf binders and similar devices are well known in the prior art. Exemplary of prior devices are those disclosed in U.S. Pat. Nos. 3,612,709; 4,056,326; and 4,761,091 which relate to the means by which replaceable leaves of paper are loosely held or bound within binders generally having front and rear covers. Common types of such binders are the extensible-post binder, such as described in U.S. Pat. No. 4,056,326, and the commonly available "three-ring" binder.

A prior file folder or paper binder device for which this invention is designed normally includes a front cover and a rear cover which are hingedly connected to a backbone portion so that the covers swing on definite hinge lines at the edges of the backbone, which is generally of fixed width. Means for retaining paper within the binder device is also normally included arranged on or adjacent the backbone portion of the binder. Such retaining means includes the well-known three-ring binding mechanism as well as the extensible-post binding mechanism.

Binders of the aforementioned type are becoming more and more useful in education and business to bind loose papers, catalogs and the like. Unfortunately, however, the storing of such binders is particularly awkward. Specifically, while the the inner edges of the covers adjacent the backbone portion of the binder are generally a fixed distance apart because of the fixed width of the backbone portion, the spacing between the outer edges of the cover is a function of the quantity of paper in the binder. When the binder is less than substantially full, the outer edges of the covers converge toward one another so that they are closer to one another than the inner edges of the covers. In fact, if only a few or no papers are in the binder, the outer edges of the covers may actually touch each other. The converging arrangement of the covers when observed in a plan view from above resembles a wedge or pie slice.

It is difficult to maintain these prior binders in a neat, orderly arrangement upon a shelf or between bookends because of the asymmetry caused by the nonparallel arrangement of the front and rear covers of the binders. As noted, binders of the aforementioned type are becoming more and more useful to society, and there has developed a particular need for the ability to stack or shelve such binders in a neat and orderly fashion.

SUMMARY OF THE INVENTION

In accordance with the present invention, spacing means is provided for maintaining the front and rear covers of a file folder or binding device substantially parallel to one another irrespective of the quantity of sheets maintained therein to facilitate the orderly stacking or shelving thereof.

The spacing means according to a presently preferred embodiment of the invention generally includes a base portion adapted to be affixed to the inside surface of one of the covers, most probably the front, or left, and a spacing portion extending substantially transversely from the base portion. The spacing portion is adapted to engage the inside surface of the opposite cover from which the base portion is attached when the device is closed to maintain a minimum distance between the covers.

The minimum distance to be maintained between the covers is generally dependent upon the fixed width of the backbone portion of the binding device. Accordingly, the spacing means of the present invention preferably also includes means for adjusting the length of the spacing portion thereof to accommodate binding devices of differing size. Most preferably, the adjusting means comprises a plurality of notches at spaced locations along the length of the spacing portion whereat an end portion of the spacing portion may be snapped or broken off at a selected notch to result in a spacing portion of a desired length to accommodate the particular binding device with which the invention is used.

The base portion of the spacing means is preferably provided with an adhesive area on its underside surface to affix the base portion of the spacing means to the inside surface of one of the covers. The adhesive area may be covered by protective paper that may be removed to expose the adhesive area prior to use.

The spacing means is preferably arranged adjacent the outer edge of the cover opposite the backbone portion of the binder. More than one spacing means is normally suggested along the outer edge of the cover to provide uniform engagement of the opposing cover when the binder is closed.

An alternative embodiment of the invention presents an improved binder-and-spacing means combination.

BRIEF DESCRIPTION OF THE DRAWINGS

Other features and advantages of the invention will appear from the following description of the representative embodiments disclosed in the accompanying drawings in which the same reference numerals designate the same or similar parts throughout the drawings.

DETAILED DESCRIPTION OF A PREFERRED EMBODIMENT

Figure 1:
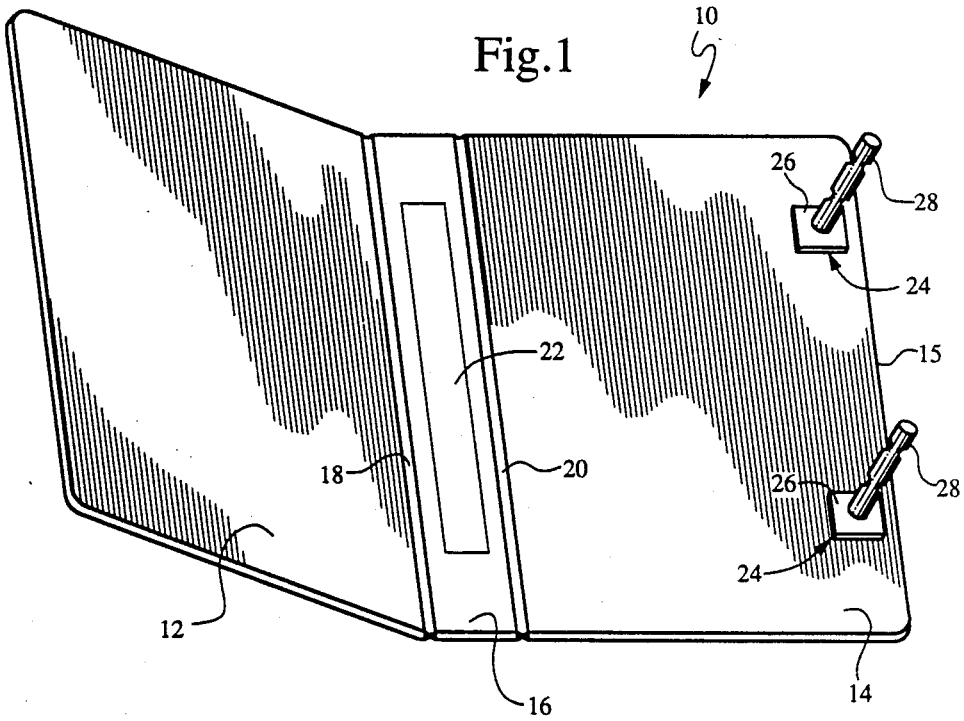
FIG. 1 is a perspective view of a binder device incorporating spacing means according to one presently preferred embodiment of the invention.
Figure 2:
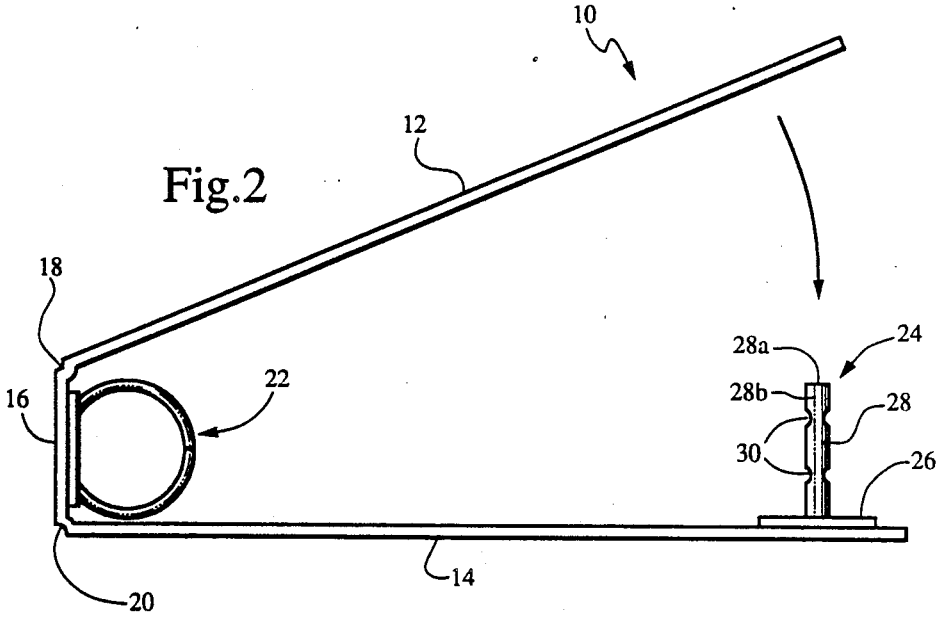
FIG. 2 is a side view of the binder device of FIG. 1 in a somewhat closed position.

A loose leaf binder device 10 according to a presently preferred embodiment of the invention is presented in FIGS. 1 and 2 comprising front cover portion 12, a rear cover portion 14 and a backbone portion 16 arranged therebetween. Hinges 18 and 20 are formed between the backbone portion 16 and the covers 12 and 14, respectively, so that the covers swing on definite hinge lines at the edges of the backbone portion. Retaining means 22 for loosely retaining replaceable leaves of paper or catalogs or the like in the binder device is provided adjacent the inside surface of backbone portion 16. Means 22 may be defined by a conventional ring-binder mechanism, commonly referred to as a "three-ring" binder, an extensible-post binder mechanism, or the like. Retaining means 22 is not necessary for the effective operation of this invention, and, accordingly, is represented only schematically in FIG. 1.

Binder device 10 also includes spacing means 24 arranged on the inside surface of rear cover 14 adjacent the outer edge 15 thereof opposite backbone portion 16. Spacing means 24 maintains a minimum distance between front cover 12 and rear cover 14 so as to maintain the covers in a substantially face-to-face parallel relation when closed. Spacing means 24 includes a base portion 26 affixed to the inside surface of the cover and a spacing portion or rod 28 extending substantially transversely from base portion 26 and the cover to which the base portion is affixed. Spacing means 24 is affixed the inside surface of rear cover 14 by conventional means, such as adhering agents or ultrasonic welding. When front cover 12 is closed, end 28*a* of spacing rod 28 engages the inside surface of front cover 12 to maintain the minimum distance between the covers. Base portion 26 may be affixed to rear cover 14 with spacing rod 28 extending therefrom to engage front cover 12, or they may be arranged alternately, that is, base portion 26 may be affixed to front cover 12 with spacing rod 28 extending therefrom to engage rear cover 14. If desired, front cover 12 may be equipped with means arranged along the inside surface of the front cover where the cover contacts ends 28*a* of the spacing rod to releasably engage end 28*a*.

Spacing means 24 is provided with means for adjusting the length of spacer rod 28 which comprises a plurality of notches 30 spaced along the length of the rod. Notches 30 are areas of decreased thickness provided in spacer rod 28 whereby end portion 28*b* may be broken or snapped off at a selected notch to accommodate the varying widths of the backbone portions utilized with various binder devices. For example, if means 24 is to be utilized with a binder device having a backbone portion of smaller width than the backbone portion of FIG. 2, one may snap or break off end portion 28*b* of spacing rod 28 to accommodate the shorter minimum distance to be maintained between the front and rear covers. Naturally, as many portions of rod 28 may be snapped off as needed.

Figure 3A:
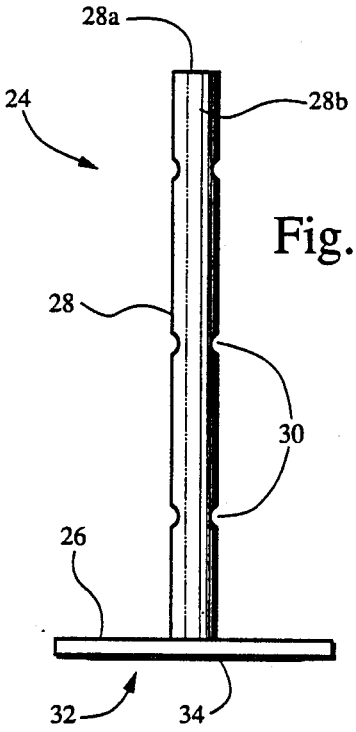
FIG. 3A is a schematic illustration of the spacing means of FIG. 1.

Spacing means 24 is shown in isolation in FIG. 3A wherein adhesive means 32 is provided on the underside of base portion 26 to affix spacing means 24 to the inside surface of the rear or front cover of the binder. Adhesive means 32 may be defined by an adhesion agent applied to the underside of base portion 26. Adhesive means 32 is covered by a protective backing or covering 34 to prevent foreign matter from coming in contact with the adhesive agent and to maintain its effectiveness prior to use. In use, backing 34 is removed to expose adhesive means 32 so that spacing means 24 may be affixed to one of the covers of the binder.

Figure 3B:
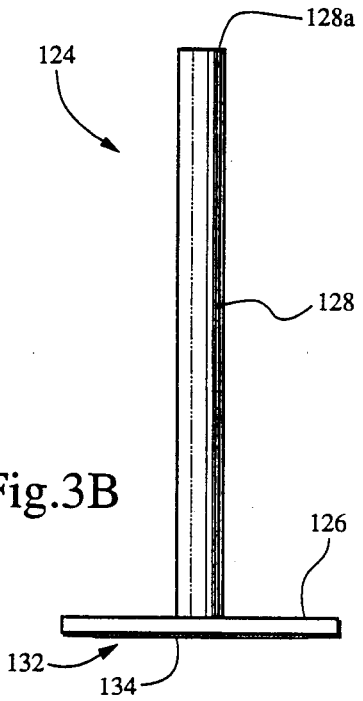
FIG. 3B is a schematic illustration of an alternative embodiment of the spacing means according the invention.

An alternative embodiment of the spacing means according to the invention is illustrated in FIG. 3B wherein a spacing means 124 is shown including a base portion 126 adapted to be affixed to the inside surface of a binder cover and a spacing portion or rod 128 extending substantially transversely from base portion 126 adapted to engage the opposite cover of the binder at end 128*a*. Spacing means 124 further includes adhesive means 132 provided on the underside of base portion 126 covered by a backing 134. Backing 134 is designed to be peeled off to expose an adhesion agent applied to the underside of the base portion. In use, adhesive means 132 affixes spacing means 124 to a cover of the binder to allow spacer rod 128 to extend from that cover and engage the opposing cover at end 128*a* to maintain them a minimum distance apart in a substantially parallel face-to-face relation. Spacing means 124 shown in FIG. 3B is similar to spacing means 24 shown in FIG. 3A except for the omission of the plurality of notches 30 which appear in FIG. 3A. Thus, spacing means 124 provides a spacer rod or portion 128 which is a single member of integral construction that may be manufactured in varying lengths to accommodate binder devices of various widths.

In the preferred embodiment of the invention, spacer rods 28 and 128 are from about two inches to about ten inches in length and from about one-eighth to about one-quarter inch in thickness. Notches 30 of rod 28 are preferably spaced at about one-inch intervals. In addition, base portions 26 and 126 are preferably about three-quarters inches square and about two millimeters in thickness.

Figure 4A:
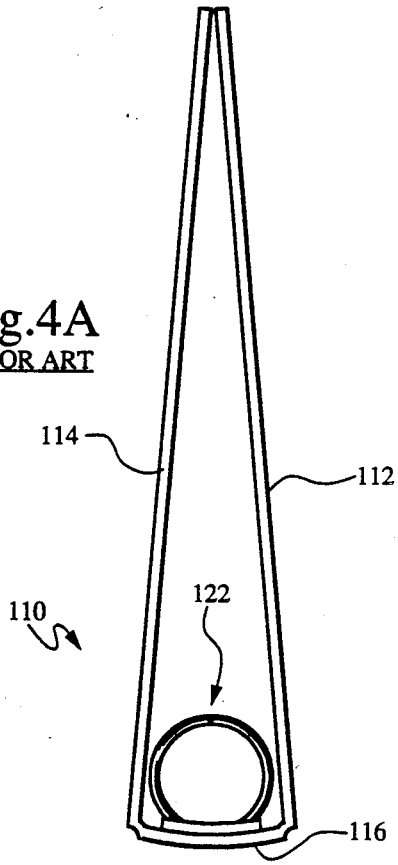
Fig.4A PRIOR ART
FIG. 4A is a top plan view of a prior art binder device.

Referring now to FIG. 4A, a conventional three-ring binder 110 is shown having a rear cover 114, a front cover 112, a backbone portion 116 and binding means 122. As one can see in FIG. 4A, when conventional binder 110 is closed, covers 112 and 114 converge toward one another and may even contact one another at their outer edges and thus are not in parallel relation to each other. This configuration forms a wedge- or pie-shaped article which does not provide orderly storage where the binders are shelved or stacked.

Figure 4B:
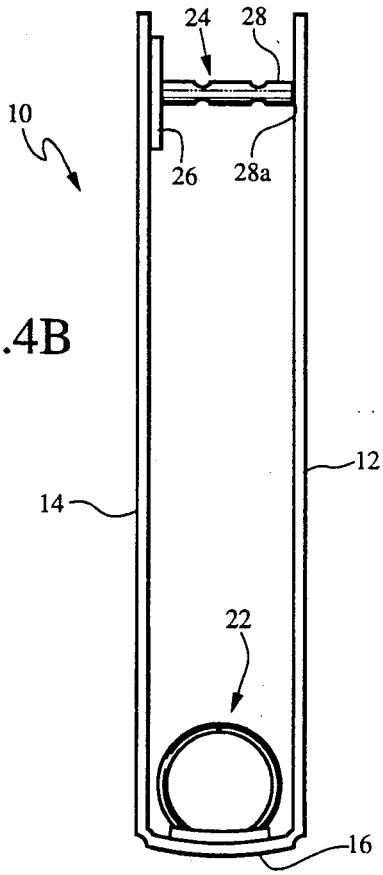
FIG. 4B is a top plan view of a binder device incorporating spacing means according to the invention.

A top plan view of the binder 10 according to the invention is shown in FIG. 4B in the closed position. In the closed position, covers 12 and 14 are in a face-to-face and substantially parallel relation; and in the open position (FIG. 1), the covers are substantially coplanar with the backbone portion 16. As shown in FIG. 4B, spacing means 24 maintains a minimum distance between front cover 12 and rear cover 14 so that the width of binder device 10 is generally equal at the backbone portion end as well as the opposite outer end. In this state, binder device 10 provides for neat and orderly storage whether it be by stacking or shelving.

While preferred embodiments of the invention have been described, it must be understood that other embodiments may be developed by those skilled in the art. It should be understood, therefore, that the invention is to be limited only insofar as is required by the scope of the following claims.

I claim:

1. A spacing means for cover panels of a binding device which includes a front cover panel, a rear cover panel and an intermediate backbone portion, said spacing means comprising:

a base portion adapted to be affixed to the inside surface of one of said cover panels;

a spacing portion extending from said base portion and adapted to engage the inside surface of the other of said cover panels to maintain said cover panels a minimum distance apart and in a substantially parallel relation when the cover panels are in a closed position; and means for adjusting the length of said spacing portion comprising a plurality of notches spaced along the length of said spacing portion, said plurality of notches defining a plurality of spaced breakable areas at which the spacing portion is breakable for adjusting the length of the spacing portion.

2. The spacing means as in claim 1 wherein the length of said spacing portion is in the range of two inches to ten inches and wherein said notches are spaced along the length of said spacing portion at one-inch intervals.

3. The spacing means as in claim 1 wherein said base portion includes adhesive means on an underside of said base portion, said adhesive means being adapted to affix said spacing means to the inside surface of said one of said cover panels.

4. The spacing means as in claim 1 wherein said base portion and said spacing portion are formed integrally of a plastic material.

5. The spacing means as in claim 1 wherein said spacing means is adapted to be affixed to the inside surface of said one of said cover panels adjacent an edge thereof which is opposite said backbone portion.

6. The spacing means as in claim 1 wherein said spacing portion extends substantially transversely from said base portion.

7. A device for holding sheet materials such as paper comprising:

a binder having a front cover, a rear cover and a backbone portion to which the covers are hinged at their inner edges for movement between an open position in which said covers are substantially coplanar with said backbone portion and a closed position; and a spacing means affixed to one of said covers adjacent an outer edge of said one cover opposite said backbone portion said spacing means comprising a base affixed to the inside surface of said one cover and a spacing rod extending substantially transversely from said base and said one cover, said spacing rod abutting the other of said covers when said covers are in the closed position for maintaining a fixed distance between said front and rear covers so that said covers are in a substantially parallel relation when said covers are in said closed position.

8. The sheet holding device as in claim 1 wherein said base and said spacing rod of said spacing member are formed integrally of a plastic material.

9. The sheet holding device as in claim 7 including at least two spaced spacing means arranged adjacent the outer edge of said one cover.

10. The sheet holding device as in claim 7 wherein the length of said spacing rod is in the range of two inches to ten inches.

11. The sheet holding device as in claim 10 wherein said spacing rod includes means for adjusting the length thereof.

12. The sheet holding device as in claim 11 wherein said adjusting means comprises a plurality of notches spaced along the length of said spacing rod, said plurality of notches defining a plurality of spaced breakable areas at which the spacing rod is breakable for adjusting the length of the spacing rod.

13. The sheet holding device as in claim 12 wherein said notches are spaced along the length of said spacing rod at one-inch intervals.

14. A spacing means for cover panels of a binding device which includes a front cover panel, a rear cover panel and an intermediate backbone portion, said spacing means comprising:

a base portion adapted to be affixed to the inside surface of one of said cover panels;

a spacing portion extending from said base portion and adapted to engage the inside surface of the other of said cover panels to maintain said cover panels a minimum distance apart and in a substantially parallel relation when the cover panels are in a closed position; and means for adjusting the length of said spacing portion comprising a plurality of breakable areas spaced along the length of said spacing portion, said plurality of breakable areas defining areas at which the spacing portion is breakable for adjusting the length of the spacing portion.

* * * * *

UNITED STATES PATENT AND TRADEMARK OFFICE

CERTIFICATE OF CORRECTION

PATENT NO. : 5,002,416

DATED : March 26, 1991

INVENTOR(S) : Russell D. Serzen

It is certified that error appears in the above-identified patent and that said Letters Patent is hereby corrected as shown below:

In col. 2, line 50, after "according", insert --to--.

In col. 6, line 3 (claim 8, line 1), change "1" to --7--.

Signed and Sealed this

Twenty-eighth Day of July, 1992

*Attest:*

DOUGLAS B. COMER

*Attesting Officer*

*Acting Commissioner of Patents and Trademarks*